US006061832A

United States Patent [19]

Morrison, Jr.

[11] Patent Number: 6,061,832

[45] Date of Patent: May 16, 2000

[54] NYLON UNDERGARMENT WITH ELASTIC SLEEVE

[76] Inventor: Lynn Morrison, Jr., 3414 Iroquois St., Baton Rouge, La. 70805

[21] Appl. No.: 09/244,396

[22] Filed: Feb. 4, 1999

[51] Int. Cl.[7] ..... A41B 1/00

[52] U.S. Cl. ..... 2/78.1; 2/69; 2/70

[58] Field of Search ..... 2/69, 78.1, 79, 2/80, 83, 78.2, 70, 78.3, 73

[56] References Cited

U.S. PATENT DOCUMENTS

| | | | |
|---|---|---|---|
| 1,249,446 | 12/1917 | Mell | 2/78.1 |
| 1,390,086 | 9/1921 | Clements | 2/78.1 |
| 1,777,215 | 9/1930 | Mcgill | 2/78.1 |
| 2,352,128 | 6/1944 | Shikles, Jr. | 2/69 |
| 5,109,546 | 5/1992 | Dicker | 2/68 |
| 5,839,122 | 11/1998 | Dicker et al. | 2/69 |
| 5,978,966 | 11/1999 | Dicker et al. | 2/69 |

*Primary Examiner*—Gloria M. Hale

[57] ABSTRACT

An undergarment system is provided including an elastic garment including a torso portion for covering a lower half of a torso of an individual and at least another portion integrally coupled to the torso portion for covering another part of the individual. Also included is an elastic sleeve mounted on the elastic garment such that the same encompasses the lower half of the torso, wherein an elasticity of the sleeve is greater than that of the garment.

10 Claims, 2 Drawing Sheets

NYLON UNDERGARMENT WITH ELASTIC SLEEVE

BACKGROUND OF THE INVENTION

1. Field of the Invention

The present invention relates to undergarments and more particularly pertains to a new nylon undergarment with elastic sleeve for concealing a pot belly of a user in a discreet manner.

2. Description of the Prior Art

The use of undergarments is known in the prior art. More specifically, undergarments heretofore devised and utilized are known to consist basically of familiar, expected and obvious structural configurations, notwithstanding the myriad of designs encompassed by the crowded prior art which have been developed for the fulfillment of countless objectives and requirements.

Known prior art undergarments and the like include U.S. Pat. No. 3,734,101; U.S. Pat. No. 3,157,183; U.S. Pat. No. 3,835,866; U.S. Pat. No. 3,651,670; U.S. Pat. No. 4,390,999; and U.S. Pat. Des. 258,770.

In these respects, the nylon undergarment with elastic sleeve according to the present invention substantially departs from the conventional concepts and designs of the prior art, and in so doing provides an apparatus primarily developed for the purpose of concealing a pot belly in a discreet manner.

SUMMARY OF THE INVENTION

In view of the foregoing disadvantages inherent in the known types of undergarments now present in the prior art, the present invention provides a new nylon undergarment with elastic sleeve construction wherein the same can be utilized for concealing a pot belly in a discreet manner.

The general purpose of the present invention, which will be described subsequently in greater detail, is to provide a new nylon undergarment with elastic sleeve apparatus and method which has many of the advantages of the undergarments mentioned heretofore and many novel features that result in a new nylon undergarment with elastic sleeve which is not anticipated, rendered obvious, suggested, or even implied by any of the prior art undergarments, either alone or in any combination thereof.

To attain this, the present invention generally comprises an elastic full body garment including a plurality of portions. Such portions include a pair of tubular leg portions constructed from nylon. The leg portions have a pair of reinforced lower leg openings. Further included is a pelvic portion constructed from nylon and having a front and a back integrally coupled to the leg portions. As shown in FIGS. 1 & 2, the pelvic portion includes a vertically oriented slit formed in the front thereof adjacent to a lower end thereof between the leg portions. The garment further includes a tubular torso portion constructed from nylon and integrally coupled to the pelvic portion with a length equal to that of the leg portions. Finally, integrally coupled to an upper end of the torso portion is a pair of shoulder straps constructed from nylon. As shown in FIGS. 1–3, an elastic sleeve constructed from spandex is mounted on an outer surface of a lower half of the torso portion. Ideally, the elastic sleeve is positioned just above the vertical slit. Stitches are preferably situated about an upper periphery and a lower periphery of the sleeve. It should be noted that a height of the elastic portion is one-half that of the torso portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new nylon undergarment with elastic sleeve apparatus and method which has many of the advantages of the undergarments mentioned heretofore and many novel features that result in a new nylon undergarment with elastic sleeve which is not anticipated, rendered obvious, suggested, or even implied by any of the prior art undergarments, either alone or in any combination thereof.

It is another object of the present invention to provide a new nylon undergarment with elastic sleeve which may be easily and efficiently manufactured and marketed.

It is a further object of the present invention to provide a new nylon undergarment with elastic sleeve which is of a durable and reliable construction.

An even further object of the present invention is to provide a new nylon undergarment with elastic sleeve which is susceptible of a low cost of manufacture with regard to both materials and labor, and which accordingly is then susceptible of low prices of sale to the consuming public, thereby making such nylon undergarment with elastic sleeve economically available to the buying public.

Still yet another object of the present invention is to provide a new nylon undergarment with elastic sleeve which provides in the apparatuses and methods of the prior art some of the advantages thereof, while simultaneously overcoming some of the disadvantages normally associated therewith.

Still another object of the present invention is to provide a new nylon undergarment with elastic sleeve for concealing a pot belly in a discreet manner.

Even still another object of the present invention is to provide a new nylon undergarment that includes an elastic garment including a torso portion for covering a lower half of a torso of an individual and at least another portion integrally coupled to the torso portion for covering another part of the individual. Also included is an elastic sleeve mounted on the elastic garment such that the same encompasses the lower half of the torso, wherein an elasticity of the sleeve is greater than that of the garment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
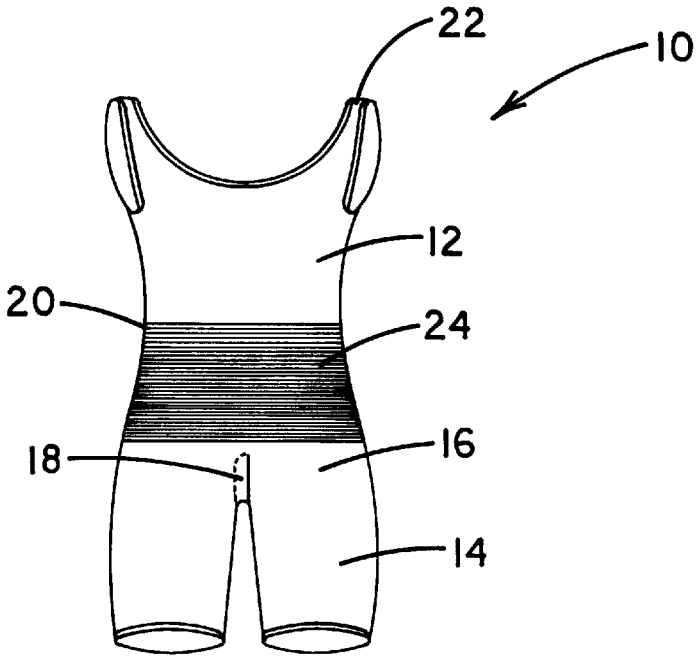
FIG. 1 is a front view of the present invention configured for use by a female user.

With reference now to the drawings, and in particular to FIGS. 1 through 5 thereof, a new nylon undergarment with elastic sleeve embodying the principles and concepts of the present invention and generally designated by the reference numeral 10 will be described.

Figure 2:
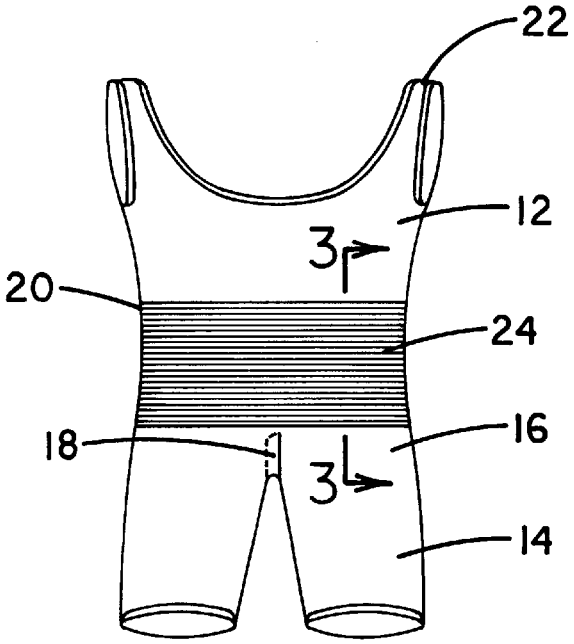
FIG. 2 is a front view of the present invention configured for use by a male user.
Figure 4:
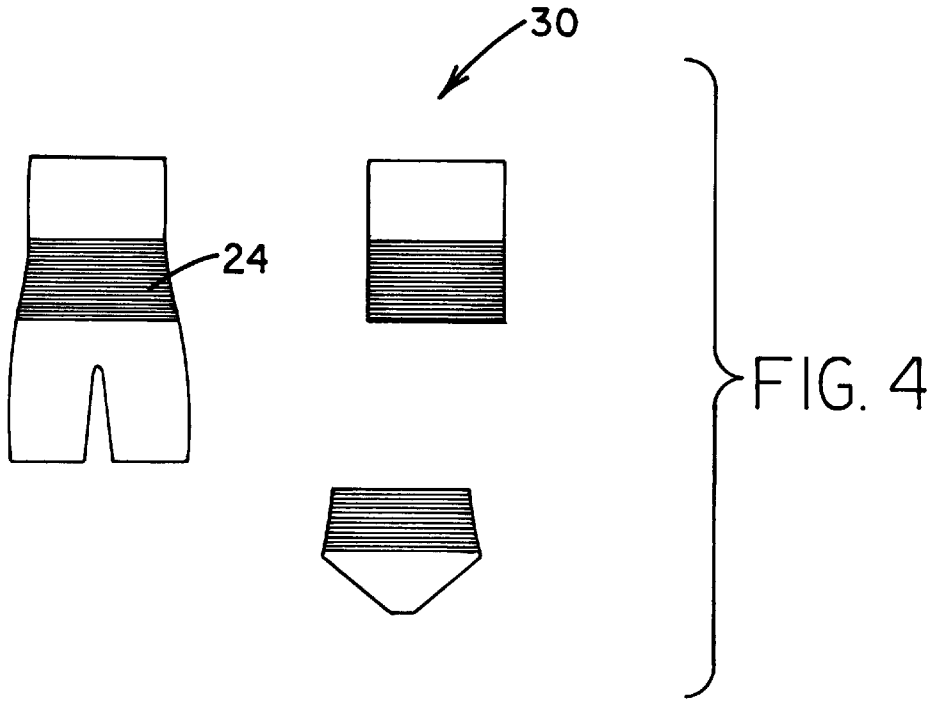
FIG. 4 is an exploded view of a set of clothing for use by a female.

The present invention, designated as numeral 10, includes an elastic full body garment 12 including a plurality of portions. Such portions include a pair of tubular leg portions 14 constructed from nylon. The leg portions have a pair of reinforced lower leg openings. Further included is a pelvic portion 16 constructed from nylon and having a front and a back integrally coupled to the leg portions. As shown in FIGS. 1 & 2, the pelvic portion includes a vertically oriented slit 18 formed in the front thereof adjacent to a lower end thereof between the leg portions. The garment further includes a tubular torso portion 20 constructed from nylon and integrally coupled to the pelvic portion with a length equal to that of the leg portions. Finally, integrally coupled to an upper end of the torso portion is a pair of shoulder straps 22 constructed from nylon. Each of the above portions preferably arc constructed from 100% nylon or silk similar to that of the art of panty hosiery. It should be noted that in an alternative embodiment, the present invention may be constructed from cotton lined with elastic or the like.

Figure 3:
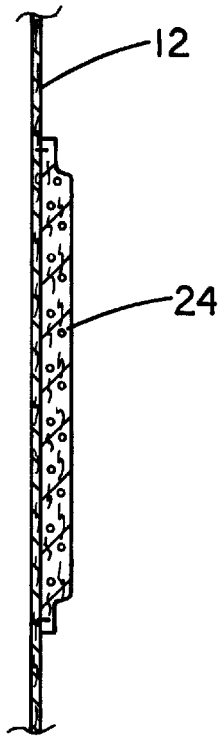
FIG. 3 is a side cross-sectional view of the present invention taken along line 3—3 shown in FIG. 2.

As shown in FIGS. 1–3, an elastic sleeve 24 constructed from spandex is mounted on an outer surface of a lower half of the torso portion. The spandex is preferably equipped with a thickness that is about 3 times that of the nylon from which the body garment is constructed. Ideally, the elastic sleeve is positioned just above the vertical slit. Stitches are preferably situated about an upper periphery and a lower periphery of the sleeve. It should be noted that a height of the elastic portion is one-half that of the torso portion of the body garment.

In various other embodiments, the present invention may include systems for use by females or males specifically. The female system 30 preferably includes a garment in addition to the garment set forth hereinabove with the exception of being without shoulder straps. Further included with the female system is a garment which merely covers the entire torso of the user. Finally, a garment is included that covers a lower half of the torso and the pelvic area of the user. Note FIG. 4. Ideally, each of the garments of the female system have an elastic sleeve that is slightly tapered at an intermediate extent thereof, when unbiased.

Figure 5:
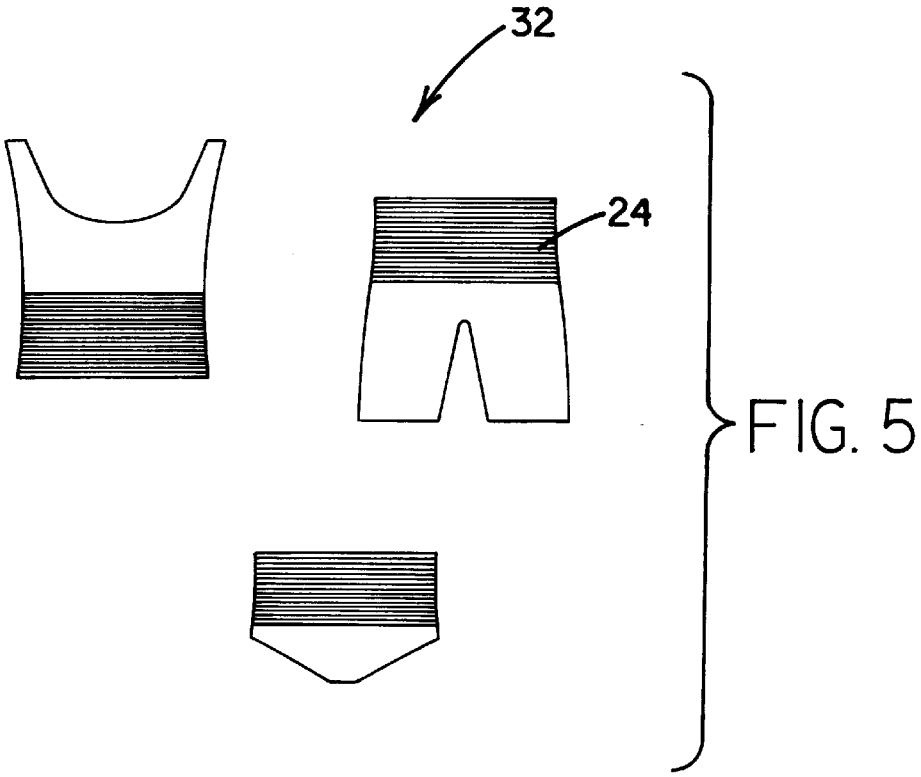
FIG. 5 is an exploded view of a set of clothing for use by a male.

As shown in FIG. 5, a male system 32 may include a garment in addition to the garment set forth hereinabove with the exception of being without leg or pelvic portions. Further such system may include a garment with just a pelvic portion and a garment with just a pelvic portion and leg portions. Further systems may be provided for users of various sizes including adults and children.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An undergarment system comprising, in combination:

an elastic full body garment including a pair of tubular leg portions constructed from nylon and having a pair of reinforced lower leg openings, a pelvic portion constructed from nylon and having a front and a back integrally coupled to the leg portions wherein the pelvic portion includes a vertically oriented slit formed in the front thereof adjacent to a lower end thereof between the leg portions, a tubular torso portion constructed from nylon and integrally coupled to the pelvic portion with a length equal to that of the leg portions, and a pair of shoulder straps constructed from nylon and each integrally coupled to an upper end of the torso portion; and an elastic sleeve constructed from spandex mounted on an outer surface of a lower half of the torso portion just above the vertical slit via stitches situated about an upper periphery and a lower periphery of the sleeve, wherein a height of the elastic portion is one-half that of the torso portion.

2. An undergarment system comprising:

an elastic garment including a torso portion for covering a lower half of a torso of an individual and a second portion integrally coupled to the torso portion for covering another part of the individual; and an elastic sleeve mounted on the elastic garment such that the same encompasses the lower half of the torso, wherein an elasticity of the sleeve is greater than that of the garment.

3. An undergarment system as set forth in claim 2 wherein the torso portion also covers an upper half of the torso of the individual and the second portion includes a pelvic portion which is in turn integrally coupled to a pair of leg portions each with a length that is equal to that of the torso portion.

4. An undergarment system as set forth in claim 2 wherein the second portion includes a pelvic portion.

5. An undergarment system as set forth in claim 4 wherein the pelvic portion includes a vertical slit formed therein.

6. An undergarment system as set forth in claim 2 wherein the torso portion also covers an upper half of the torso of the individual and the second portion includes a pair of shoulder straps.

7. An undergarment system as set forth in claim 2 wherein the second portion includes a pelvic portion which is in turn integrally coupled to a pair of leg portions each with a length that is twice that of the torso portion.

8. An undergarment system as set forth in claim 2 wherein the garment is constructed from nylon.

9. An undergarment system as set forth in claim 2 wherein the sleeve is constructed from spandex.

10. An undergarment system as set forth in claim 9 wherein the garment is constructed from nylon.

* * * * *